US008831235B2

(12) United States Patent
Yoshino

(10) Patent No.: US 8,831,235 B2
(45) Date of Patent: Sep. 9, 2014

(54) SPEAKER POLARITY DETERMINATION DEVICE

(75) Inventor: Hajime Yoshino, Edogawa (JP)

(73) Assignee: Pioneer Corporation, Kanagawa (JP)

( * ) Notice: Subject to any disclaimer, the term of this patent is extended or adjusted under 35 U.S.C. 154(b) by 563 days.

(21) Appl. No.: 13/201,859

(22) PCT Filed: Feb. 26, 2009

(86) PCT No.: PCT/JP2009/053542

§ 371 (c)(1),
(2), (4) Date: Aug. 17, 2011

(87) PCT Pub. No.: WO2010/097924

PCT Pub. Date: Sep. 2, 2010

(65) Prior Publication Data

US 2011/0299691 A1 Dec. 8, 2011

(51) Int. Cl.
*H04R 29/00* (2006.01)

(52) U.S. Cl.
CPC ..... *H04R 29/00* (2013.01)
USPC ..... 381/58; 381/59

(58) Field of Classification Search
CPC ..... H04R 29/00; H04R 29/001; H04R 5/04; H04R 2420/05; H04S 7/301; H04S 7/302; H04S 3/00; G01S 11/14
USPC ..... 381/58, 59, 56, 95, 96
See application file for complete search history.

(56) References Cited

U.S. PATENT DOCUMENTS

| | | | | |
|---|---|---|---|---|
| 6,681,019 | B1 * | 1/2004 | Kitano et al. | 381/59 |
| 6,970,568 | B1 * | 11/2005 | Freeman et al. | 381/58 |
| 7,734,054 | B2 * | 6/2010 | Asada | 381/58 |
| 2006/0050891 | A1 * | 3/2006 | Bharitkar | 381/59 |
| 2006/0062399 | A1 * | 3/2006 | McKee Cooper et al. | 381/58 |

FOREIGN PATENT DOCUMENTS

| | | |
|---|---|---|
| JP | 49-106315 | 10/1974 |
| JP | 06-311578 | 11/1994 |
| JP | 2002-330500 | 11/2002 |
| JP | 3480636 | 10/2003 |
| JP | 2004-297368 | 10/2004 |
| JP | 2008-191315 | 8/2008 |

OTHER PUBLICATIONS

International Search Report—PCT/JP2009/053542—Jun. 2, 2011.

* cited by examiner

*Primary Examiner* — Vivian Chin
*Assistant Examiner* — David Ton
(74) *Attorney, Agent, or Firm* — Young & Thompson

(57) ABSTRACT

A speaker determination device determines a polarity of a speaker connected to output terminals. Test sound is outputted to an acoustic space via the connected speaker and is collected by a microphone. A reference signal is generated based on the test signal. A polarity determining unit compares predetermined frequency range components of the microphone signal obtained by the microphone and the reference signal, and determines the polarity of the speaker, i.e., whether the speaker is connected in positive phase or in negative phase.

16 Claims, 6 Drawing Sheets

(DIRECT CONNECTION TYPE)

(REVERSE CONNECTION TYPE)

SPEAKER POLARITY DETERMINATION DEVICE

TECHNICAL FIELD

The present invention relates to a technique of determining polarity of speakers in an apparatus which outputs sound via the speakers.

BACKGROUND TECHNIQUE

There is known an acoustic apparatus, such as an audio product and a home theater product, which is connected with speakers and outputs sound. When speakers are connected to such an apparatus, it is normally necessary to connect a plus (+) terminal and a minus (−) terminal to a plus terminal and a minus terminal of output terminals of the apparatus, respectively. It is called that speaker polarity is positive when the plus terminals and the minus terminals are correctly connected. In contrast, it is called that speaker polarity is negative when the plus terminals and the minus terminals are reversely connected.

When the speaker is negatively connected, the phase of the sound outputted by the speaker is reversed, and generally reproduction quality is deteriorated. Therefore, there is proposed a technique of employing a function of determining the polarity of speaker on the acoustic apparatus side. For example, Patent References 1 and 2 disclose a technique of determining polarity of speaker by outputting a reference sound signal prepared in advance from a speaker, collecting the outputted sound by a microphone and comparing the collected signal with the reference sound signal.

Practically, various kinds of speakers are connected to the acoustic apparatus according to a kind and a purpose of the acoustic apparatus. Patent References 1 and 2 do not provide a determination method particularly in consideration of kinds and/or characteristics of speakers.

Patent Reference 1: Japanese Patent Application Laid-open under No. H06-311578

Patent Reference 2: Japanese Patent No. 3480636

DISCLOSURE OF INVENTION

Problem to be Solved by the Invention

The present invention is made to solve the above-mentioned problem. It is an object of the present invention to provide a speaker determination device effective for various kinds of speakers.

Means for Solving the Problem

A speaker polarity determination device according to claim 1 is characterized by: output terminals to which a speaker is connected; a test sound outputting unit which supplies a test signal to the output terminals and outputs test sound to an acoustic space via the speaker; a microphone which is arranged in the acoustic space and which collects the test sound to generate a microphone signal; a signal generating unit which generates a reference signal corresponding to the test signal; and a polarity determining unit which compares predetermined frequency range components of the microphone signal and the reference signal to determine a polarity of the speaker connected to the output terminals.

BRIEF DESCRIPTION OF REFERENCE NUMBERS

Figure 1:
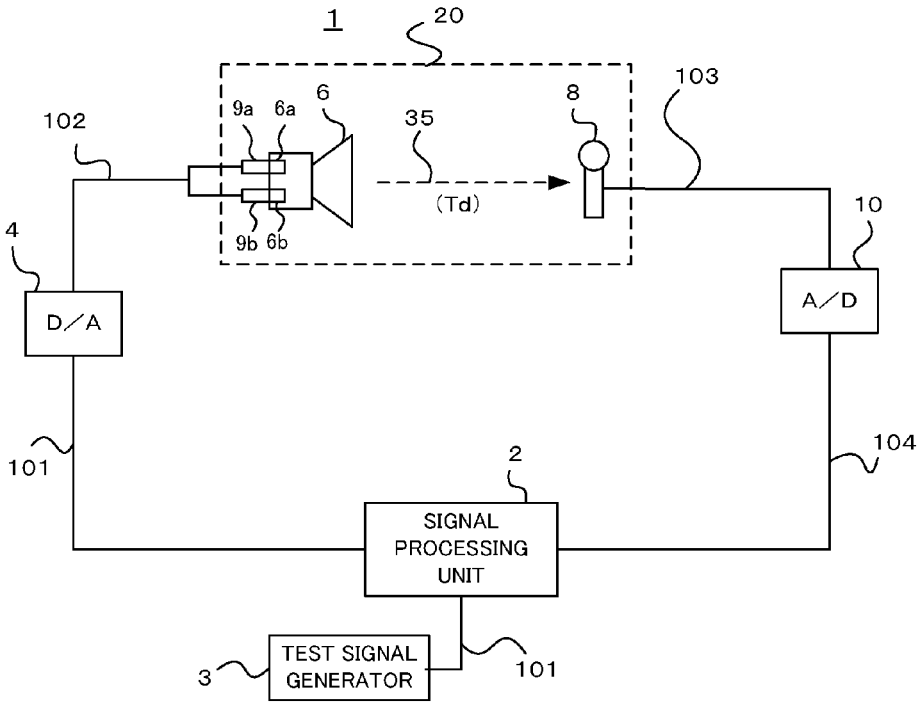
FIG. 1 is a block diagram illustrating a schematic configuration of an acoustic apparatus to which a speaker polarity determination device according to the present invention is applied.

1 Acoustic apparatus
2 Signal processing unit
6 Speaker
8 Microphone
50 Speaker determining unit
51 Filter unit
52 Distance correcting unit
53 Reference signal generating unit
54 Polarity determining unit
55 Reliability determining unit

DETAILED DESCRIPTION OF THE PREFERRED EMBODIMENTS

According to one aspect of the present invention, there is provided a speaker polarity determination device including: output terminals to which a speaker is connected; a test sound outputting unit which supplies a test signal to the output terminals and outputs test sound to an acoustic space via the speaker; a microphone which is arranged in the acoustic space and which collects the test sound to generate a microphone signal; a signal generating unit which generates a reference signal corresponding to the test signal; and a polarity determining unit which compares predetermined frequency range components of the microphone signal and the reference signal to determine a polarity of the speaker connected to the output terminals.

The above-described speaker determination device determines a polarity of a speaker connected to output terminals. Test sound is outputted to the acoustic space via the connected speaker and is collected by the microphone. The reference signal is generated based on the test signal. The polarity determining unit compares predetermined frequency range components of the microphone signal obtained by the microphone and the reference signal, and determines the polarity of the speaker, i.e., whether the speaker is connected in positive phase or in negative phase.

One mode of the above speaker polarity determination device includes a distance correcting unit which measures a delay time corresponding to a distance between the speaker and the microphone based on the microphone signal, and performs a time axis adjustment between the microphone signal and the reference signal, used by the polarity determining unit, based on the delay time. Thus, the polarity determination can be accurately performed after adjusting the delay time caused by the distance between the speaker and the microphone.

Another mode of the above speaker polarity determination includes a speaker determining unit which determines whether the speaker is a full-range speaker or a mid/high-range speaker based on the microphone signal, and the polarity determining unit compares mid-range components of the microphone signal and the reference signal to determine the polarity of the speaker when the speaker determining unit determines that the speaker is the mid/high-range speaker.

In this mode, when the connected speaker is the mid/high-range speaker, the low-range component in the microphone signal is insufficient, and hence the polarity determination is performed by using the mid-range components of the reference signal and the microphone signal.

Still another mode of the above speaker polarity determination device includes a reliability determining unit which determines a reliability of a determination result by the polarity determining unit based on the microphone signal and the reference signal. In a case where the speaker determining unit determines that the speaker is the full-range speaker, the polarity determining unit compares low-range components of the microphone signal and the reference signal to determine the polarity of the speaker and the reliability determining unit determines the reliability of the determination result, and the polarity determining unit outputs the determination result only when the reliability determining unit determines that the reliability of the determination result is high.

In this mode, if it is determined that the speaker is the full-range speaker, the reliability of the determination result by the polarity determining unit is determined by the reliability determining unit. Then, if it is determined that the reliability is high, the determination result is used.

In still another mode of the speaker polarity determination device, the polarity determining unit compares mid-range components of the microphone signal and the reference signal to determine the polarity of the speaker and outputs the determination result when the reliability determining unit determines that the reliability of the determination result is low.

In this mode, if the reliability determining unit determines that the reliability of the polarity determination is low, the polarity determination is additionally performed by using the mid-range components of the microphone signal and the reference signal, and the determination result is used. Thereby, the accuracy of the polarity determination can be ensured.

In still another mode of the above speaker polarity determination device, the reliability determining unit calculates a power of an addition signal of the microphone signal and the reference signal and a power of a subtraction signal of the microphone signal and the reference signal, and determines that the reliability of the determination result is high if a power difference between the power of the addition signal and the power of the subtraction signal is equal to or larger than a predetermined value and determines that the reliability of the determination result is low if the power difference is smaller than the predetermined value. Thereby, the accuracy of the polarity determination result can be ensured for a bass-reflex type speaker in which the phase in low-range component is disturbed, for example.

In still another mode of the above speaker polarity determination device, the polarity determining unit compares magnitudes or powers of an addition signal of the microphone signal and the reference signal and a subtraction signal of the microphone signal and the reference signal, and determines that the speaker is connected in positive phase if the addition signal is larger than the subtraction signal and determines that the speaker is connected in negative phase if the addition signal is smaller than the subtraction signal. Thereby, it becomes possible to accurately determine whether the speaker connection is in positive phase or in negative phase.

EMBODIMENT

A preferred embodiment of the present invention will be described below with reference to the attached drawings.

[Apparatus Configuration]

FIG. 1 illustrates a schematic configuration of an acoustic apparatus 1 to which a speaker polarity determination device according to the present invention is applied. The acoustic apparatus 1 is connected with a speaker 6, and a sound signal from a sound source not shown, such as a CD or DVD, is reproduced via the speaker 6. It is noted that the speaker polarity determination described below is performed when the speaker 6 is connected to the acoustic apparatus 1, prior to reproduction from the sound source.

The acoustic apparatus 1 includes a signal processing unit 2, a test signal generator 3, a D/A converter 4, a microphone 8, output terminals 9 to which the speaker 6 is connected, and an A/D converter 10. The speaker 6 and the microphone 8 are arranged in an acoustic space 20. The acoustic space 20 may be a listening room or a home theater, for example.

The test signal generator 3 generates a test signal 101 such as pink noise or white noise, and supplies it to the signal processing unit 2. The test signal 101 may be stored in a memory in the test signal generator 3 as a digital signal.

The signal processing unit 2 supplies the test signal 101 to the D/A converter 4. The D/A converter 4 converts the test signal 101 to an analog test signal 102, and supplies it to a plus terminal 9*a* and a minus terminal 9*b*. In this specification, when the plus terminal 9*a* and the minus terminal 9*b* are not discriminated from each other, they are expressed as the output terminal 9. The signal processing unit 2 applies filtering on the test signal 101 by using a filter of a predetermined frequency, and generates a reference signal.

Meanwhile, the speaker 6 has the plus terminal 6*a* and the minus terminal 6*b*. The speaker 6 is connected to the output terminals 9 of the acoustic apparatus 1. It is a correct connection state that the plus terminal 6*a* of the speaker 6 is connected to the plus output terminal 9*a* of the acoustic apparatus 1 and the minus terminal 6*b* of the speaker 6 is connected to the minus output terminal 9*b* of the acoustic apparatus 1, which is called a connection state in "positive phase". In contrast, it is an incorrect connection state that the plus terminal 6*a* of the speaker 6 is connected to the minus output terminal 9*b* of the acoustic apparatus 1 and the minus terminal 6*b* of the speaker 6 is connected to the plus output terminal 9*a* of the acoustic apparatus 1, which is called a connection state in "negative phase". The present invention aims to detect the connection state in negative phase.

The speaker 6 connected to the output terminals 9 outputs test sound 35, corresponding to the test signal 101 supplied via the output terminals 9, to the acoustic space 20. The microphone 8 collects the test sound 35 in the acoustic space 20, and supplies it to the A/D converter 10 as an analog microphone signal 103. The A/D converter 10 converts the microphone signal 103 to a digital microphone signal 104, and supplies it to the signal processing unit 2. The signal processing unit 2 determines the polarity of the speaker 6 based on the microphone signal 104 and the reference signal generated inside.

Figure 2:
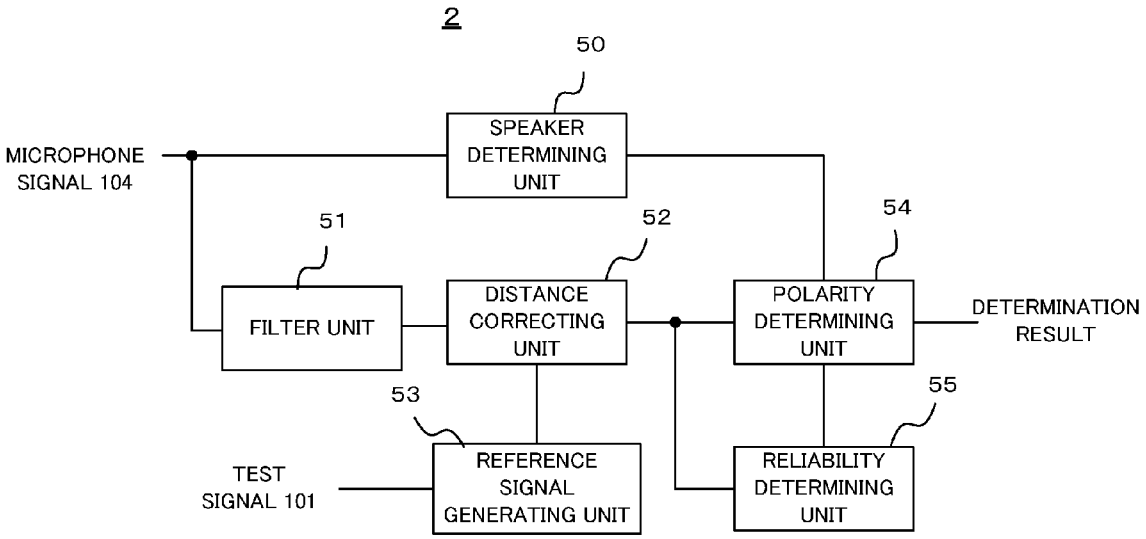
FIG. 2 is a block diagram illustrating an internal configuration of a signal processing unit shown in FIG. 1.

FIG. 2 illustrates an internal configuration of the signal processing unit 2. As illustrated, the signal processing unit 2 includes a speaker determining unit 50, a filter unit 51, a distance correcting unit 52, a reference signal generating unit 53, a polarity determining unit 54 and a reliability determining unit 55. Preferably, the signal processing unit 2 is constituted by a DSP (Digital Signal Processor). The microphone signal 104 outputted by the A/D converter 10 is inputted to the speaker determining unit 50 and the filter unit 51.

Figure 3A:
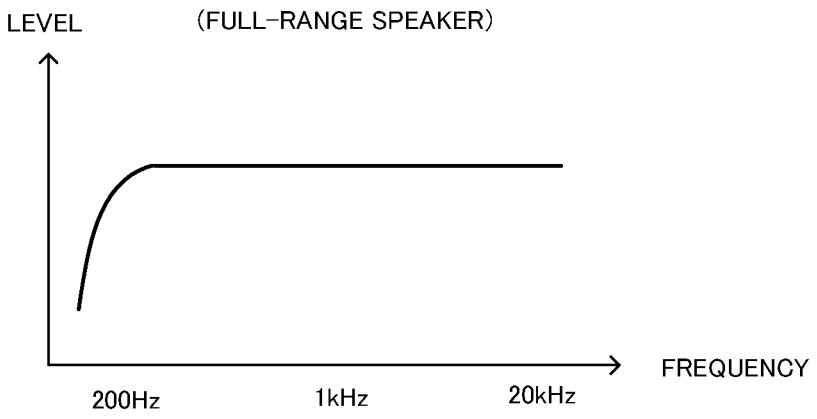
FIGS. 3A and 3B are diagrams illustrating kinds and characteristics of speakers.
Figure 3B:
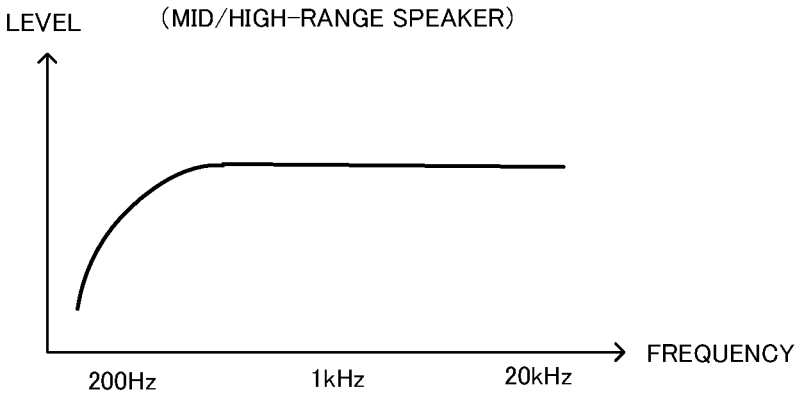

The speaker determining unit 50 determines various kinds of speakers subjected to the polarity determination. In this embodiment, the speaker determining unit 50 classifies the speakers 6 into a full-range speaker and a mid/high-range speaker. FIG. 3A illustrates a frequency characteristic of a full-range speaker, and FIG. 3B illustrates a frequency characteristic of a mid/high-range speaker. The full-range speaker is a speaker capable of reproducing sound from low-range to high-range. In contrast, the mid/high-range speaker is a speaker capable of reproducing sound from mid-range to high-range, but its reproduction capability at low-range is low. In the examples of FIGS. 3A and 3B, reproduction capability of the mid/high-range speaker is insufficient in the range equal to or lower than 200 Hz, compared with the full-range speaker. This embodiment changes the frequency range used in the polarity determination described later in accordance with the kind of the speaker. For this purpose, the speaker determining unit 50 for determining the kind of the speaker is provided.

The determining method by the speaker determining unit 50 will be described. The acoustic apparatus 1 reproduces a low-range test signal and a mid-range test signal, as the test signal, in a state that the speaker 6 subjected to the determination is connected to the acoustic apparatus 1, and obtains the microphone signal of those test signals by the microphone 8. Here, the frequency of the low-range test signal is approximately 200 Hz and the frequency of the mid-range test signal is approximately 1 kHz, for example.

The low-range microphone signal and the mid-range microphone signal are supplied to the speaker determining unit 50 as the microphone signal 104. The speaker determining unit 50 compares the power of the low-range microphone signal and the power of the mid-range microphone signal. If the power of the low-range microphone signal is roughly equal to the power of the mid-range microphone signal, the speaker determining unit 50 determines that the speaker is a full-range speaker. On the contrary, if the power of the low-range microphone signal is smaller than the power of the mid-range microphone signal, the speaker determining unit 50 determines that the speaker is amid/high-range speaker. The speaker determining unit 50 supplies the determination result thus obtained to the polarity determining unit 54.

Next, a supplementary explanation will be given of the full-range speaker. Speakers of various configurations are known as a full-range speaker capable of reproducing sound over low-range. For example, a bass-reflex type speaker is classified into a full-range speaker. A bass-reflex type speaker has such a feature that the phase of the reproduced signal is easily disturbed at low-range, due to its configuration.

Figure 4A:
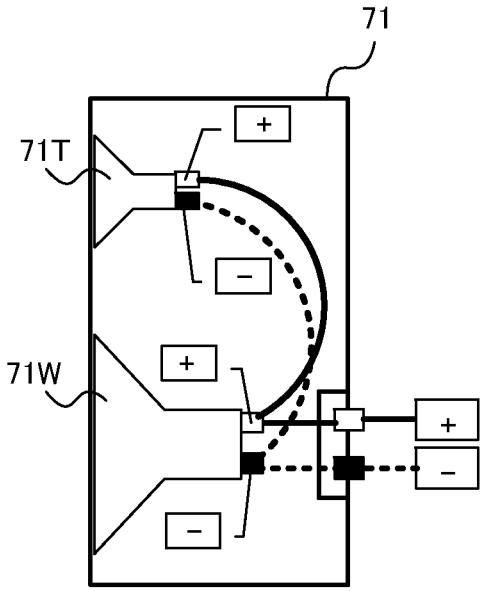
FIGS. 4A and 4B are diagrams illustrating connection examples of multiway speakers.
Figure 4B:
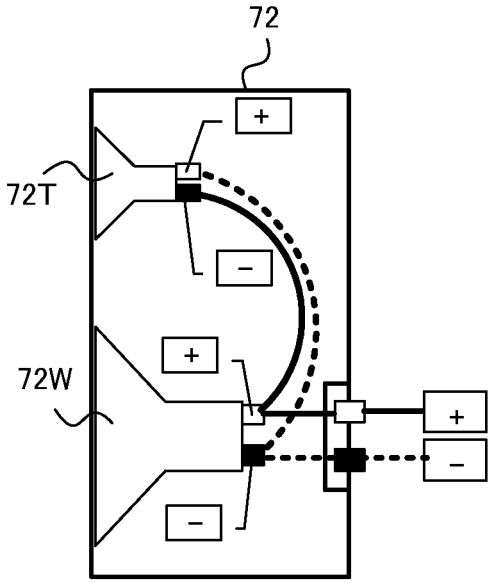

Further, as shown in FIGS. 4A and 4B, a multiway speaker having multiple speaker units is also classified into a full-range speaker. FIG. 4A illustrates a multiway speaker 71 having a tweeter 71T and a woofer 71W as the speaker unit. The multiway speaker of this kind normally has such a configuration that the woofer 71W and the tweeter 71T are connected to each other by their plus terminals and the minus terminals, respectively. This is called "direct connection type", for convenience. In contrast, in the market, there is a one like a speaker 72 having such a configuration that a woofer 72W and a tweeter 72T are connected with reverse polarity, as illustrated in FIG. 4B. This is called "reverse connection type", for convenience. In the case of the multiway speaker 72 of reverse connection type, the phase of the low-range signal reproduced by the woofer 72W is opposite to the phase of the mid/high-range signal reproduced by the tweeter 72T. While the details will be described later, it is a characteristic feature of this embodiment that the polarity determination is performed in consideration of the full-range speaker as described above.

Returning to FIG. 2, the filter unit 51 filters the microphone signal 104 to a predetermined frequency, and supplies it to the distance correcting unit 52. In this embodiment, the filter unit 51 performs the filtering by a LPF of 200 Hz or a BPF of 500 Hz.

The reference signal generating unit 53 generates a reference signal from the test signal 101. Specifically, the reference signal generating unit 53 applies the filtering to the test signal 101, by the same filter as that the filter unit 51 uses for filtering the microphone signal 104, and generates the reference signal. Namely, when the filter unit 51 filters the microphone signal 104 by the LPF (Low Pass Filter) of 200 Hz, the reference signal generating unit 53 filters the test signal 101 by the LPF of 200 Hz to generate the reference signal, and supplies it to the distance correcting unit 52. When the filter unit 51 filters the microphone signal 104 by the BPF (Band Pass Filter) of 500 Hz, the reference signal generating unit 53 filters the test signal 101 by the BPF of 500 Hz to generate the reference signal, and supplies it to the distance correcting unit 52.

The distance correcting unit 52 corrects the delay of the signal corresponding to the distance between the speaker 6 and the microphone 8 arranged in the acoustic space 20. When the test sound is outputted to the acoustic space 20 based on the test signal and is collected by the microphone 8, the microphone signal includes the delay of the time that the test sound takes to reach from the speaker 6 to the microphone 8, i.e., the delay time Td. The delay time Td is proportional to the distance between the speaker 6 and the microphone 8.

Figure 5A:
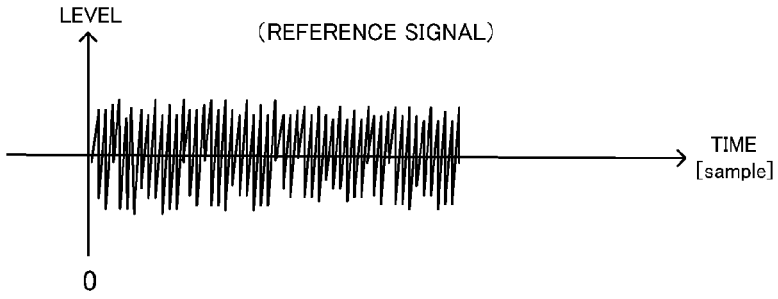
FIGS. 5A to 5C are diagrams for explaining a method of a distance correction.
Figure 5B:
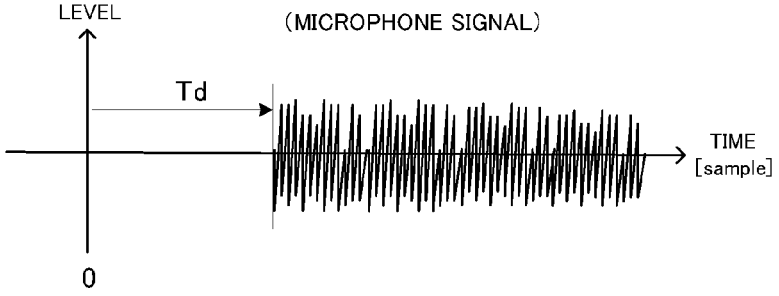
Figure 5C:
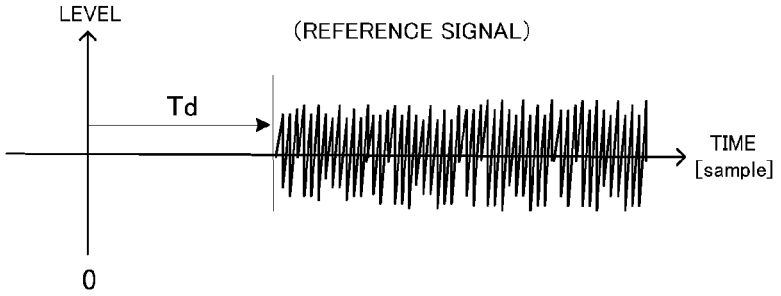

FIGS. 5A to 5C illustrate a method of the distance correction. The reference signal is generated by the reference signal generating unit 53. In FIG. 5A, the front position of the reference signal is set to a time 0 on the time axis, for convenience. As illustrated in FIG. 5B, the microphone signal obtained by the microphone 8 has the above-mentioned delay time Td. Therefore, as illustrated in FIG. 5C, the distance correcting unit 52 delays the reference signal by the delay time Td in the microphone signal to coincides the time axis of the reference signal with the time axis of the microphone signal, i.e., performs a time axis adjustment. The distance correcting unit 52 measures the delay time Td prior to the distance correction, and stores it in a storage unit or the like not shown. As a measurement method of the delay time Td, a method can be used by which a pulse test signal is reproduced by the speaker 6 and collected by the microphone 8 and the time difference between the reproduction timing of the test signal and the timing of the pulse component in the microphone signal is obtained. The distance correcting unit 52 supplies the reference signal and the microphone signal, to which the adjustment on the time axis is applied by the distance correction in this way, to the polarity determining unit 54.

The polarity determining unit 54 compares the reference signal and the microphone signal to determine the polarity of the speaker. The reference signal and the microphone signal used here are the ones obtained by the distance correction by the distance correcting unit 52 as described above.

Figure 6A:
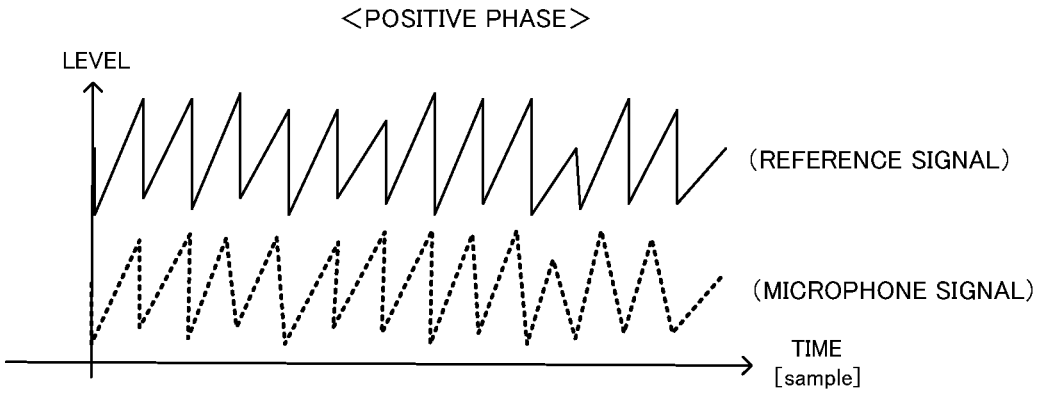
FIGS. 6A and 6B are diagrams for explaining a method of a polarity determination.
Figure 6B:
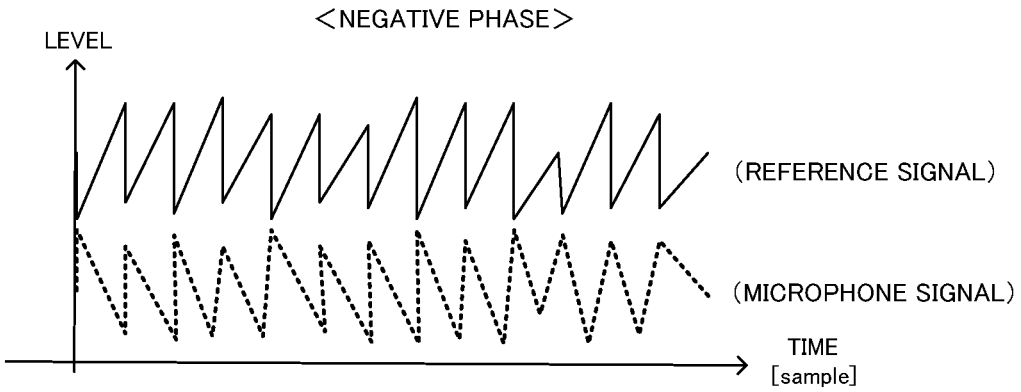

FIG. 6A illustrates a phase relation between the reference signal and the microphone signal when the speaker connection is in positive phase, and FIG. 6B illustrates a phase relation between the reference signal and the microphone signal when the speaker connection is in negative phase. FIGS. 6A and 6B schematically illustrate the waveforms of the reference signal and the microphone signal after being band-limited by a certain frequency. As is understood from FIGS. 6A and 6B, when the speaker connection is in positive phase, the phases of the reference signal and the microphone signal are in positive phase (in-phase). On the contrary, when the speaker connection is in negative phase, the phases of the reference signal and the microphone signal are in negative phase. Therefore, basically, it is possible to determine whether the speaker connection is in positive phase or in negative phase, by comparing the reference signal and the microphone signal to detect the phase relation between them.

There are some methods of comparing the reference signal and the microphone signal. Basically, a method is used by which the reference signal and the microphone signal are interfered with each other. For example, as a first method, a method can be used by which the reference signal and the microphone signal are simply added to each other. In this case, the polarity determining unit 54 determines that the speaker connection is in positive phase when the waveform of the signal after the addition is larger than the waveform of one or both of the signals before the addition, and determines that the speaker connection is in negative phase when the waveform of the signal after the addition is smaller than the waveform of one or both of the signals before the addition.

As a second method, a method can be used by which an addition signal obtained by adding the reference signal and the microphone signal and a subtraction signal obtained by subtracting one of the reference signal and the microphone signal from the other are generated, and the addition signal and the subtraction signal are compared with each other. In this case, the magnitudes of the addition signal and the subtraction signal may be compared with each other, and the powers of the addition signal and the subtraction signal may be calculated and compared with each other. As is understood from FIGS. 6A and 6B, when the speaker connection is in positive phase, the magnitude or the power of the addition signal becomes almost twice, and the magnitude or the power of the subtraction signal becomes close to zero. On the contrary, when the speaker connection is in negative phase, the magnitude or the power of the addition signal becomes close to zero, and the magnitude or the power of the subtraction signal becomes almost twice. In this view, the polarity determining unit 54 determines that the speaker connection is in positive phase when the addition signal is larger than the subtraction signal, and determines that the speaker connection is in negative phase when the addition signal is smaller than the subtraction signal.

Next, the filtering by the filter unit 51 and the reference signal generating unit 53 will be described. The filter unit 51 and the reference signal generating unit 53 performs the filtering by the same filter. In this embodiment, the reference signal generating unit 53 and the filter unit 51 perform the filtering basically at low frequency, e.g., by a LPF of 200 Hz. Then, after the distance correction by the distance correcting unit 52, the polarity determining unit 54 compares the microphone signal filtered by the LPF of 200 Hz with the reference signal obtained by filtering the test signal by the LPF of 200 Hz.

The reason for using the low frequency band component lower than 200 Hz is as follows. As described with reference to FIGS. 4A and 4B, the full-band speaker used in this embodiment includes the reverse connection type multiway speaker as shown in FIG. 4B. In such a speaker, the phase at low-range is opposite to the phase at mid/high-range. Generally, in many cases, the border of the low-range component and the mid/high-range component of such a speaker is around 160 Hz. In this embodiment, for such a multiway speaker of reverse-connection type, the polarity of the speaker is defined based on the low-range. Namely, the state that the woofer 72W is connected to the acoustic apparatus 1 in positive phase as illustrated in FIG. 4B is regarded as a correct connection state. In that case, it is necessary to determine the speaker polarity at the frequency band of the woofer 72W. Therefore, in this embodiment, the polarity determining unit 54 compares the reference signal generated by the LPF of 200 Hz with the microphone signal filtered by the LPF of 200 Hz, in principle. By this, the polarity can be determined based on the low-range for the multiway speaker of reverse connection type. In view of determining the polarity based on the low-range, the frequency band may be limited to a frequency lower than 200 Hz. However, if the frequency band is limited to a too low frequency, the determination accuracy may be deteriorated because the frequency band overlaps with the frequency of standing waves to be influenced or S/N becomes low. For this reason, the filtering is performed by the LPF of about 200 Hz in a preferred example in this embodiment.

While it is preferred that the frequency range used in the polarity determination is basically about 200 Hz as described above, there are two exceptions.

A first exception is the case that the speaker is a mid/high-range speaker. Since the low-range component is insufficient in the mid/high-range speaker as illustrated in FIG. 3B, the S/N cannot be ensured and the accuracy is deteriorated if the polarity is determined by using the low-range component of the reference signal and the microphone signal. Therefore, the mid-range component about 500 Hz is used to determine the polarity for the mid/high-range speaker. Specifically, the polarity determining unit 54 compares the reference signal generated by filtering the test signal by a BPF of 500 Hz with the microphone signal filtered by the BPF of 500 Hz. By this, the polarity of mid/high-range speaker, which originally includes little low-range component, can be accurately determined.

A second exception is the case that the reliability of the polarity determination result after the band-limiting by the 200 Hz LPF is low. As is already mentioned, the full-range speaker of this embodiment includes a bass-reflex type speaker. Generally, it is likely in the bass-reflex type speaker that the phase of the low-range component is disturbed. Therefore, in the bass-reflex type speaker, the accuracy of the polarity determination using the low-range component cannot be ensured. Therefore, in this embodiment, the reliability determining unit 55 determines the reliability of the polarity determination result obtained by using the low-range component equal to or lower than 200 Hz, and performs the polarity determination again by using the mid-range component of about 500 Hz if the reliability is low. Thus, accurate determination can be performed for the speaker, such as a bass-reflex type speaker, whose phase in the low-range component is disturbed.

Next, the reliability determination performed by the reliability determining unit 55 will be described. The reliability determining unit 55 calculates and compares the power Pa of the addition signal of the reference signal and the microphone signal with the power Ps of the subtraction signal of the reference signal and the microphone signal supplied from the distance correction unit 52. As is understood from FIGS. 6A and 6B, if the phase disturbance does not exist in the low-range component, the power Pa of the addition signal becomes almost twice and the power Ps of the subtraction signal becomes close to zero when the speaker connection is in positive phase. In contrast, the power Pa of the addition signal becomes close to zero and the power Ps of the subtraction signal becomes almost twice when the speaker connection is in negative phase. Therefore, if the phase disturbance does not exist in the low-range component, the power Pa of the addition signal and the power Ps of the subtraction signal have a sufficient difference. On the contrary, if the phase disturbance exists in the low-range component, the difference between the power Pa of the addition signal and the power Ps of the subtraction signal becomes small, due to the phase disturbance component. Therefore, the reliability determining unit 55 determines that the polarity determination result performed by using the low-range component equal to or lower than 200 Hz is reliable if the difference (Pa−Ps) between the power Pa of the addition signal and the power Ps of the subtraction signal is equal to or larger than a predetermined value (e.g., 3 dB), and determines that the polarity determination result performed by using the low-range component equal to or lower than 200 Hz is not reliable if the difference is smaller than the predetermined value. Since the reliability determination unit 55 performs reliability determination in this way, the polarity determination accuracy can be improved for the speaker, such as a bass-reflex type speaker, whose phase of the low-range component of the reproduction signal is disturbed.

[Polarity Determination Process]

First, basic procedure of the polarity determination process will be described. At the time of performing the speaker polarity determination, first the distance correction is performed for the speaker subjected to the polarity determination. This is because, if the distance correction according to the arrangement of the speaker is not performed, the phase of the microphone signal becomes unknown, and the polarity determination cannot be correctly performed. The distance correction is performed by using the pulse signal, i.e., the high-range signal, as described above.

Next, the polarity determination is performed. In the market, there is a multiway speaker of reverse connection type as illustrated in FIG. 4B. In order to correctly perform the polarity determination for such a speaker, it is necessary to perform the polarity determination based on the low-range component, in principle. Therefore, in principle, the polarity determination is performed by comparing the microphone signal filtered by the 200 Hz LPF with the reference signal generated by filtering the test signal by the 200 Hz LPF. Performing the polarity determination based on the low-range component does not cause any problem to the multiway speaker of direct connection type shown in FIG. 4A. Namely, it is the basic procedure of the speaker polarity determination that the distance correction is performed by using the high-range component, and then the polarity determination is performed by using the low-range component.

However, in the case of the mid/high-range speaker described above, the power becomes insufficient and correct determination cannot be performed if the microphone signal is filtered by the 200 Hz LPF. Therefore, the speaker determination is performed at the start of the process, and the polarity determination is performed by using the mid-range component for the mid/high-range speaker, as an exception. Namely, the polarity determination is performed by comparing the microphone signal filtered by the 500 Hz BPF with the reference signal obtained by filtering the test signal by the 500 Hz BPF.

Further, even in the speakers determined to be the low-range speaker, there is a speaker, such as the above-mentioned bass-reflex type speaker, for which performing the polarity determination using the low-range component is not appropriate. Therefore, the reliability determination is performed, and the polarity determination is exceptionally performed by using the mid-range component if the reliability is low.

Figure 7:
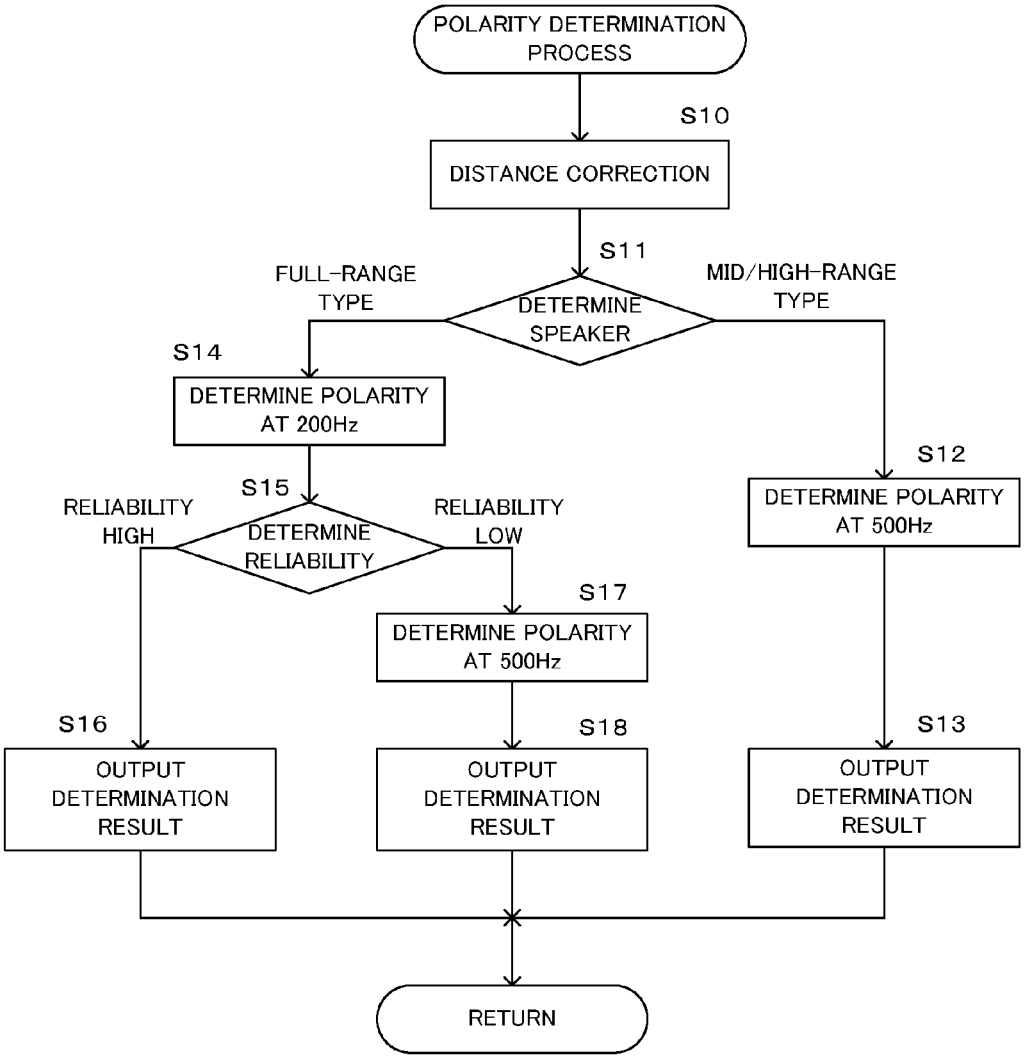
FIG. 7 is a flowchart illustrating a polarity determination process.

Next, a specific example of the polarity determination process will be described. FIG. 7 is a flowchart of the polarity determination process. The polarity determination process is executed by the constitutional elements illustrated in FIG. 2.

First, the signal processing unit 2 outputs the test sound from the speaker 6, and collects it by the microphone 8 to obtain the microphone signal. Then, the distance correction unit 52 performs the distance correction by using the delay time Td measured in advance as described above, and performs the time axis adjustment of the reference signal and the microphone signal (step S10).

Next, the speaker determination unit 50 compares the power of the low-range component and the power of the mid-range component to determine whether the speaker currently connected is the full-range speaker or the mid/high-range speaker (step S11).

If it is determined that the speaker 6 currently connected is the mid/high-range speaker, the polarity determining unit 54 performs the polarity determination by using the mid-range component around 500 Hz (step S12). Namely, the polarity determining unit 54 compares the magnitude or power of the reference signal generated by using the 500 Hz BPF and the microphone signal filtered by the 500 Hz BPF to perform the polarity determination. Then, the polarity determining unit 54 outputs the obtained determination result on the display unit of the acoustic apparatus 1, for example. Thus, a user can know whether the speaker is correctly connected or not.

If it is determined that the speaker currently connected is the full-range speaker in step S11, the polarity determining unit 54 first performs the polarity determination by using the low-range component equal to or lower than 200 Hz (step S14). Namely, the polarity determining unit 54 compares the reference signal generated by using the 200 Hz LPF with the microphone signal filtered by the 200 Hz LPF to obtain the polarity determination result. Then, the polarity determining unit 54 temporarily stores the determination result.

Next, the reliability determining unit 55 performs the reliability determination by using the reference signal and the microphone signal identical to step S14 (step S15). This reliability determination is to confirm whether or not the polarity determination result obtained by using the low-range component equal to or lower than 200 Hz is reliable. If it is determined that the reliability is high, the polarity determining unit 54 outputs the result of the polarity determination performed in step S14 (step S16). On the contrary, if it is determined that the reliability is low, the polarity determining unit 54 discards the determination result obtained in step S14, and newly performs the polarity determination by using the mid-range component around 500 Hz (step S17). Namely, the polarity is determined by comparing the reference signal generated by using the 500 Hz BPF with the microphone signal filtered by the 500 Hz BPF. Then, the polarity determining unit 54 outputs the obtained determination result (step S18). Thus, the polarity determination process ends.

According to the polarity determination process as described above, first by the distance correction in step S10, it becomes possible to perform accurate polarity determination after correcting the propagation delay of the sound wave caused by the distance between the speaker and the microphone.

Further, since the speaker determination is performed in step S11 and the polarity is determined for the mid/high-range speaker by using the mid-range component around 500 Hz, it becomes possible to accurately perform the polarity determination for the mid/high-range speaker in which low-range component is insufficient.

Further, as to the full-range speaker, since the polarity determination is performed first by the low-range component equal to or lower than 200 Hz, it becomes possible to perform the polarity determination based on the low-range component even for a multiway speaker of reverse connection type. Furthermore, the reliability of the polarity determination is determined at the low-range, and the polarity determination is performed once again by using the mid-range component around 500 Hz if the reliability is low. Therefore, the determination accuracy can be improved even for a speaker, such as a bass-reflex type speaker, in which phase of the low-range component is disturbed. The cause by which the reliability determination unit 55 determines that the reliability is low may be the bass-reflex type speaker, the influence of group delay due to the network circuit of the speaker, the influence of the reflection by walls in the acoustic space and the orientation of the speaker not correctly directed to the microphone. However, in any case, the determination accuracy can be improved by performing the reliability determination and performing the polarity determination once again by using the mid-range component if the reliability is low.

Modified Example

The above embodiment described the polarity determination for one speaker, i.e., one channel sound signal. As an actual acoustic apparatus 1, an equipment performing multichannel reproduction, e.g., a sound reproduction equipment or an AV reproduction equipment, is used, and multiple speakers are connected to the acoustic apparatus 1. In that case, basically the above-described polarity determination process is executed for each of the speakers. However, if the distance correction is performed for multiple speakers and the delay time is measured at the time of setting the acoustic apparatus 1, the result can be stored and used for the distance correction in the polarity determination process. In addition, if various kinds of automatic sound field correction, such as a frequency characteristic correction and a delay correction, are performed in the acoustic apparatus 1, the polarity determination according to the present invention can be performed by using the microphone signal obtained at that time. For example, when a frequency characteristic correction is performed by using pink noise as a test signal as an automatic sound field correction, the microphone signal obtained at that time can be used to execute the polarity determination, and thereby the total time required for the acoustic characteristic correction can be reduced.

INDUSTRIAL APPLICABILITY

The speaker polarity determination device according to the present invention can be used for a home theater product and an audio product.

The invention claimed is:

1. A speaker polarity determination device comprising:

output terminals to which a speaker is connected;

a test sound outputting unit which supplies a test signal to the output terminals and outputs test sound to an acoustic space via the speaker;

a microphone which is arranged in the acoustic space and which collects the test sound to generate a microphone signal;

a reference signal generating unit which generates a reference signal corresponding to the test signal;

a speaker determining unit which determines whether the speaker is a full-range speaker or a mid/high-range speaker based on the microphone signal;

a polarity determining unit which compares predetermined frequency range components of the microphone signal and the reference signal to determine a polarity of the speaker connected to the output terminals; and a reliability determining unit which determines a reliability of a determination result by the polarity determining unit based on the microphone signal and the reference signal, wherein, in a case where the speaker determining unit determines that the speaker is the full-range speaker, the polarity determining unit compares low-range components of the microphone signal and the reference signal to determine the polarity of the speaker and the reliability determining unit determines the reliability of the determination result, and the polarity determining unit outputs the determination result only when the reliability determining unit determines that the reliability of the determination result is high.

2. The speaker polarity determination device according to claim 1, further comprising a distance correcting unit which measures a delay time corresponding to a distance between the speaker and the microphone based on the microphone signal, and performs a time axis adjustment between the microphone signal and the reference signal, used by the polarity determining unit, based on the delay time.

3. The speaker polarity determination device according to claim 2, wherein the reliability determining unit calculates a power of an addition signal of the microphone signal and the reference signal and a power of a subtraction signal of the microphone signal and the reference signal, and determines that the reliability of the determination result is high if a power difference between the power of the addition signal and the power of the subtraction signal is equal to or larger than a predetermined value and determines that the reliability of the determination result is low if the power difference is smaller than the predetermined value.

4. The speaker polarity determination device according to claim 3, wherein the polarity determining unit compares magnitudes or powers of an addition signal of the microphone signal and the reference signal and a subtraction signal of the microphone signal and the reference signal, and determines that the speaker is connected in positive phase if the addition signal is larger than the subtraction signal and determines that the speaker is connected in negative phase if the addition signal is smaller than the subtraction signal.

5. The speaker polarity determination device according to claim 2, wherein the polarity determining unit compares magnitudes or powers of an addition signal of the microphone signal and the reference signal and a subtraction signal of the microphone signal and the reference signal, and determines that the speaker is connected in positive phase if the addition signal is larger than the subtraction signal and determines that the speaker is connected in negative phase if the addition signal is smaller than the subtraction signal.

6. The speaker polarity determination device according to claim 1, wherein the polarity determining unit compares mid-range components of the microphone signal and the reference signal to determine the polarity of the speaker when the speaker determining unit determines that the speaker is the mid/high-range speaker.

7. The speaker polarity determination device according to claim 6, wherein the reliability determining unit calculates a power of an addition signal of the microphone signal and the reference signal and a power of a subtraction signal of the microphone signal and the reference signal, and determines that the reliability of the determination result is high if a power difference between the power of the addition signal and the power of the subtraction signal is equal to or larger than a predetermined value and determines that the reliability of the determination result is low if the power difference is smaller than the predetermined value.

8. The speaker polarity determination device according to claim 7, wherein the polarity determining unit compares magnitudes or powers of an addition signal of the microphone signal and the reference signal and a subtraction signal of the microphone signal and the reference signal, and determines that the speaker is connected in positive phase if the addition signal is larger than the subtraction signal and determines that the speaker is connected in negative phase if the addition signal is smaller than the subtraction signal.

9. The speaker polarity determination device according to claim 6, wherein the polarity determining unit compares magnitudes or powers of an addition signal of the microphone signal and the reference signal and a subtraction signal of the microphone signal and the reference signal, and determines that the speaker is connected in positive phase if the addition signal is larger than the subtraction signal and determines that the speaker is connected in negative phase if the addition signal is smaller than the subtraction signal.

10. The speaker polarity determination device according to claim 1, the polarity determining unit compares mid-range components of the microphone signal and the reference signal to determine the polarity of the speaker and outputs the determination result when the reliability determining unit determines that the reliability of the determination result is low.

11. The speaker polarity determination device according to claim 10, wherein the reliability determining unit calculates a power of an addition signal of the microphone signal and the reference signal and a power of a subtraction signal of the microphone signal and the reference signal, and determines that the reliability of the determination result is high if a power difference between the power of the addition signal and the power of the subtraction signal is equal to or larger than a predetermined value and determines that the reliability of the determination result is low if the power difference is smaller than the predetermined value.

12. The speaker polarity determination device according to claim 11, wherein the polarity determining unit compares magnitudes or powers of an addition signal of the microphone signal and the reference signal and a subtraction signal of the microphone signal and the reference signal, and determines that the speaker is connected in positive phase if the addition signal is larger than the subtraction signal and determines that the speaker is connected in negative phase if the addition signal is smaller than the subtraction signal.

13. The speaker polarity determination device according to claim 10, wherein the polarity determining unit compares magnitudes or powers of an addition signal of the microphone signal and the reference signal and a subtraction signal of the microphone signal and the reference signal, and determines that the speaker is connected in positive phase if the addition signal is larger than the subtraction signal and determines that the speaker is connected in negative phase if the addition signal is smaller than the subtraction signal.

14. The speaker polarity determination device according to claim 1, wherein the reliability determining unit calculates a power of an addition signal of the microphone signal and the reference signal and a power of a subtraction signal of the microphone signal and the reference signal, and determines that the reliability of the determination result is high if a power difference between the power of the addition signal and the power of the subtraction signal is equal to or larger than a predetermined value and determines that the reliability of the determination result is low if the power difference is smaller than the predetermined value.

15. The speaker polarity determination device according to claim 14, wherein the polarity determining unit compares magnitudes or powers of an addition signal of the microphone signal and the reference signal and a subtraction signal of the microphone signal and the reference signal, and determines that the speaker is connected in positive phase if the addition signal is larger than the subtraction signal and determines that the speaker is connected in negative phase if the addition signal is smaller than the subtraction signal.

16. The speaker polarity determination device according to claim 1, wherein the polarity determining unit compares magnitudes or powers of an addition signal of the microphone signal and the reference signal and a subtraction signal of the microphone signal and the reference signal, and determines that the speaker is connected in positive phase if the addition signal is larger than the subtraction signal and determines that the speaker is connected in negative phase if the addition signal is smaller than the subtraction signal.

* * * * *